US009097499B2

(12) United States Patent
Goehring, III et al.

(10) Patent No.: US 9,097,499 B2
(45) Date of Patent: Aug. 4, 2015

(54) CROSSBOW AND BOLTS

(71) Applicants: Jack J. Goehring, III, McLean, VA (US); Jonathan Widdifield, McLean, VA (US)

(72) Inventors: Jack J. Goehring, III, McLean, VA (US); Jonathan Widdifield, McLean, VA (US)

( * ) Notice: Subject to any disclaimer, the term of this patent is extended or adjusted under 35 U.S.C. 154(b) by 0 days.

(21) Appl. No.: 14/227,973

(22) Filed: Mar. 27, 2014

(65) Prior Publication Data

US 2014/0290636 A1 Oct. 2, 2014

Related U.S. Application Data

(60) Provisional application No. 61/853,073, filed on Mar. 28, 2013.

(51) Int. Cl.
*F41B 5/12* (2006.01)
*F42B 6/02* (2006.01)

(52) U.S. Cl.
CPC ... *F42B 6/02* (2013.01); *F41B 5/12* (2013.01); *F41B 5/123* (2013.01)

(58) Field of Classification Search
CPC ..... F41B 5/12
See application file for complete search history.

(56) References Cited

U.S. PATENT DOCUMENTS

| | | | | |
|---|---|---|---|---|
| 785,050 | A * | 3/1905 | Saunders | 124/25 |
| 4,651,707 | A * | 3/1987 | Bozek | 124/17 |
| 5,720,268 | A * | 2/1998 | Koltze | 124/25 |
| 8,443,790 | B2 | 5/2013 | Pestrue | |
| 8,578,918 | B1 * | 11/2013 | Islas | 124/25 |
| 2011/0041820 | A1 * | 2/2011 | Stanziale | 124/25 |
| 2012/0298087 | A1 * | 11/2012 | Trpkovski | 124/25 |

* cited by examiner

*Primary Examiner* — John Ricci
(74) *Attorney, Agent, or Firm* — Steptoe & Johnson LLP

(57) ABSTRACT

A crossbow and bolts are described herein. The crossbow may include a main frame defining a groove, a top limb, a bottom limb, a string and a trigger assembly. The top limb may extend in front of the main frame and be positioned above the lower limb. The string may be configured to be cocked backwards and engage with the trigger assembly. A bolt may be configured to attach to the string and be ejected from the crossbow when the trigger assembly is fired. The bolt may include a removable tip, a removable coupling, and a snap-on fletching. The crossbow may include a worm gear assembly to cock the string for firing.

20 Claims, 6 Drawing Sheets

CROSSBOW AND BOLTS

RELATED APPLICATIONS

This application claims priority to U.S. Provisional Patent Application No. 61/853,073 entitled "CrossFire," which was filed on Mar. 27, 2013, which is incorporated by reference in its entirety.

FIELD OF THE INVENTION

The exemplary embodiments of the invention relate generally to a crossbow, and bolts/arrow for use with a crossbow.

BACKGROUND OF THE INVENTION

Crossbows have been used for centuries. In the Medieval times, crossbows were used for warfare. While crossbows have largely been replaced by firearms for use in warfare, crossbows are still commonly used for hunting and shooting sports.

Typical crossbows consist of two opposing limbs, which are mounted at one end of a frame and include a string that is attached to one end of each of the opposing limbs. The string can be cocked, or drawn along the length of the frame, to create tension in the string for firing a bolt or an arrow. Typically the opposing limbs on crossbows are slightly concave and extend back towards the frame. Alternatively, crossbows may utilize opposing limbs that form a U-shape. Crossbows may also utilize a cam or pulley at the end of each of the opposing limbs to help facilitate bending of the limbs and store additional energy that may be used to fire bolts or arrows. In conventional crossbows, when the string is cocked, the limbs are drawn toward each other, and an angle of approximately 90 degrees is formed between the two limbs.

Typical crossbows have drawbacks. They are often large, bulky, and/or heavy, which makes them cumbersome and hard to carry. A standard crossbow having opposed limbs may be 36 inches wide by 40 inches long. Accordingly, a need exists for a smaller, more compact and powerful crossbow.

SUMMARY

In accordance with at least one embodiment of the invention, an apparatus, such as a crossbow is described. In at least one embodiment, the apparatus may include a main frame defining a groove. The apparatus may include a plurality of extensions extending from a front portion of the main frame. In at least one embodiment, the apparatus includes a first and a second extension extending outwardly from the front portion of the main frame. A top limb may be mounted to the first extension and a bottom limb may be mounted to the second extension. The top limb may extend inwardly toward the main frame and extend above the main frame. The bottom limb may extend inwardly toward the main frame and extend below the bottom limb. Each of the top and bottom limbs may define an unsupported. The unsupported ends may be configured to engage a string. The string may extend between the unsupported end of the top limb and the unsupported end of the bottom limb and be configured to extend across the top surface of the main frame.

The apparatus may include a trigger assembly mounted to a rear end of the main frame. The trigger assembly may be configured to receive at least a portion of the string and fire a bolt that engages the at least a portion of the string. The upper limb and lower limb may be configured such that a bolt can be discharged between the upper and lower limbs.

In at least one aspect of the invention, a bolt is described. A bolt may include a body, a coupling, a tip, and a nock. The bolt may further include a fletching. In at least one embodiment, the fletching may snap-on to a portion of the body. In at least one embodiment, the coupling is removably attached to the body and the tip is removably attached to the coupling. The bolt may be configured to only contact the main frame at two points, one point on the coupling and the end of the bolt.

One object of the invention is to create a more powerful crossbow. Another object of the invention is to create a more compact and lightweight crossbow over conventional crossbows. In at least one embodiment, by reducing the size of the limbs over that of a conventional crossbow, a smaller angle may be formed between the limbs when the string is cocked, creating more power over that of a conventional crossbow. By creating more power, heavier objects are able to be propelled from the crossbow. In addition, by reducing the size of the limbs over that of a conventional crossbow, the limbs accelerate faster than the limbs of a conventional crossbow when the crossbow is fired.

Another object of the invention is to create a quieter crossbow. By reducing the distance between the limbs and the length of the string, less oscillation will occur when the crossbow is fired. This may reduce the amount of noise that is emitted from the crossbow over that of a conventional crossbow.

Figure 1:
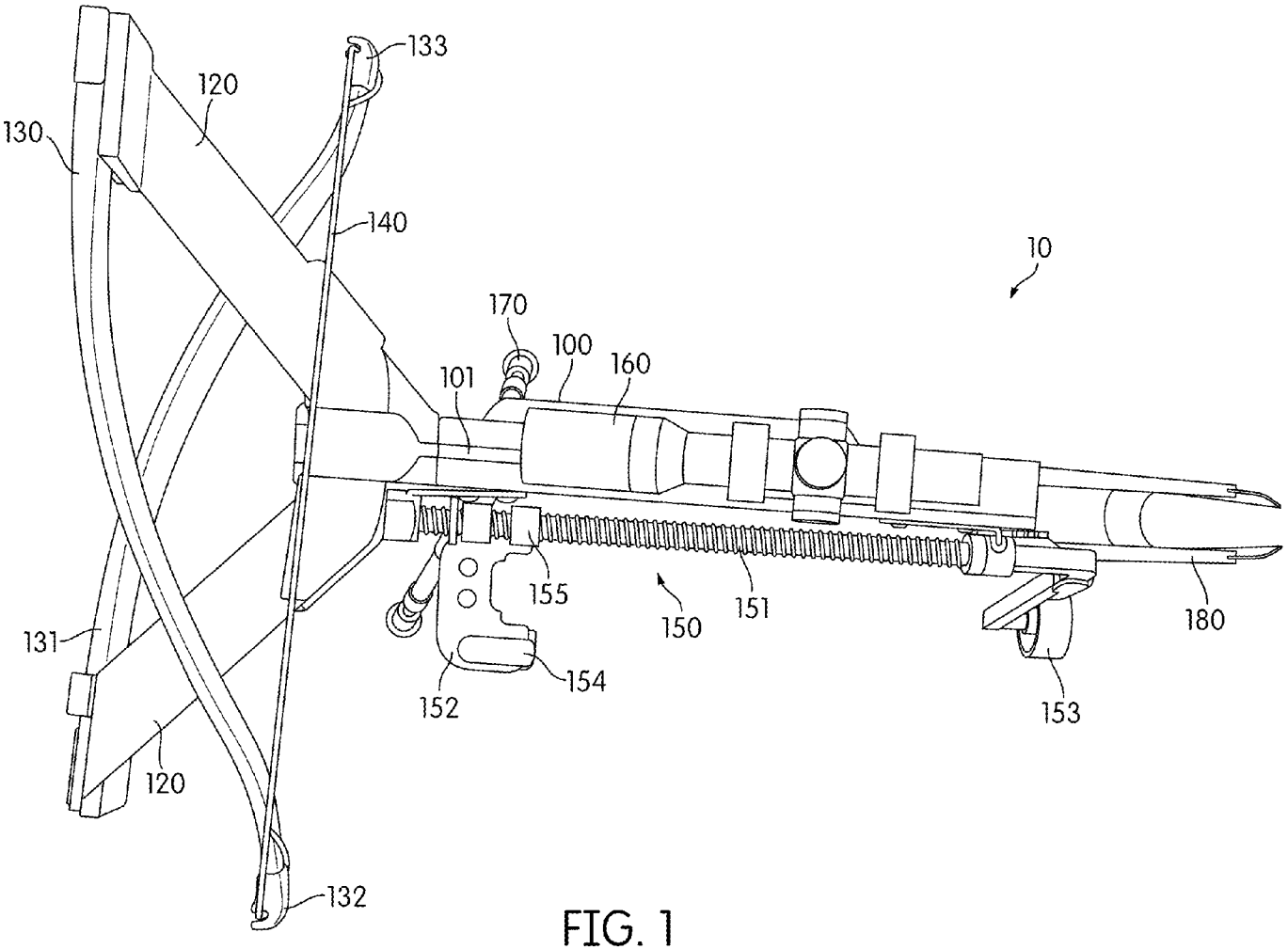
FIG. 1 illustrates a top view of a crossbow in accordance with at least one embodiment of the invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, the use of the term "mount," "mounted" or "mounting" is meant to broadly include any technique or method of mounting, attaching, joining or coupling one part to another, whether directly or indirectly.

DETAILED DESCRIPTION

The invention may be embodied in various forms. Referring to the Figures wherein like numerals indicate like elements, FIG. 1 illustrates an apparatus 10, such as a crossbow. The crossbow 10 may include a main frame 100 having a front end and a rear end. The main frame 100 may be made of any suitable material. For example, the main frame 100 may be made of metal, plastic, fiberglass, fiber weave materials, Kevlar, or carbon fiber. In at least one embodiment, the total weight of the crossbow 100 ranges between 5 and 10 pounds. Alternatively, the crossbow may be lighter or heavier. The main frame 100 may define a groove 101. The groove 101 may be formed on a top surface of the main frame 100. The groove 101 may be centered on the main frame 100 or off-centered. The groove 101 may extend along the entire length of the top surface of the main frame 100. Alternatively, the groove 101 may extend along only a portion of the length of the top surface of the main frame 100.

The main frame 100 may include a plurality of extensions 120 extending from one or more surfaces of the main frame 100. The plurality of extensions 120 may be mounted to the main frame 100 or may be of unitary construction with the main frame 100. In at least one embodiment, a first extension 120 extends from a first side of the top surface of the main frame 100. The first extension 120 may extend outwardly from the main frame at an angle. A second extension 120 may extend from a second side of the top surface of the main frame 100. The second extension 120 may extend outwardly from the main frame at an angle. The extensions 120 may be attached to and extend from a front end or front portion of the main frame 100. In at least one embodiment, the extensions 120 form a wishbone shape at the front of the main frame 100.

The extensions 120 may be attached to the main frame 100 in any suitable manner. For example, the extensions 120 may be of unitary construction with the main frame 100 or may be welded or mechanically attached to the main frame 100. In at least one embodiment, a top limb 130 is mounted to an end of the first extension 120 and a bottom limb 131 is mounted to an end of the second extension 120. The limbs 130, 131 may be mounted to the extensions 120 in any suitable manner. For example, the limbs 130, 131 may be welded or mechanically attached to the extensions 120.

In at least one embodiment, the extensions 120 may each include a projection 121 extending the vertical direction. In this embodiment, the limbs 130, 131 may be configured to attach to the projections 121. The projections 121 may be mounted in any suitable manner to the extensions 121 or may be of unitary construction with the extensions 120. In at least one embodiment, one projection 121 is configured to extend upwardly from the first extension 120 and attach to the upper limb 130 and another projection 131 is configured to extend downwardly from the second extension 120 and attach to the lower limb 131.

Figure 3:
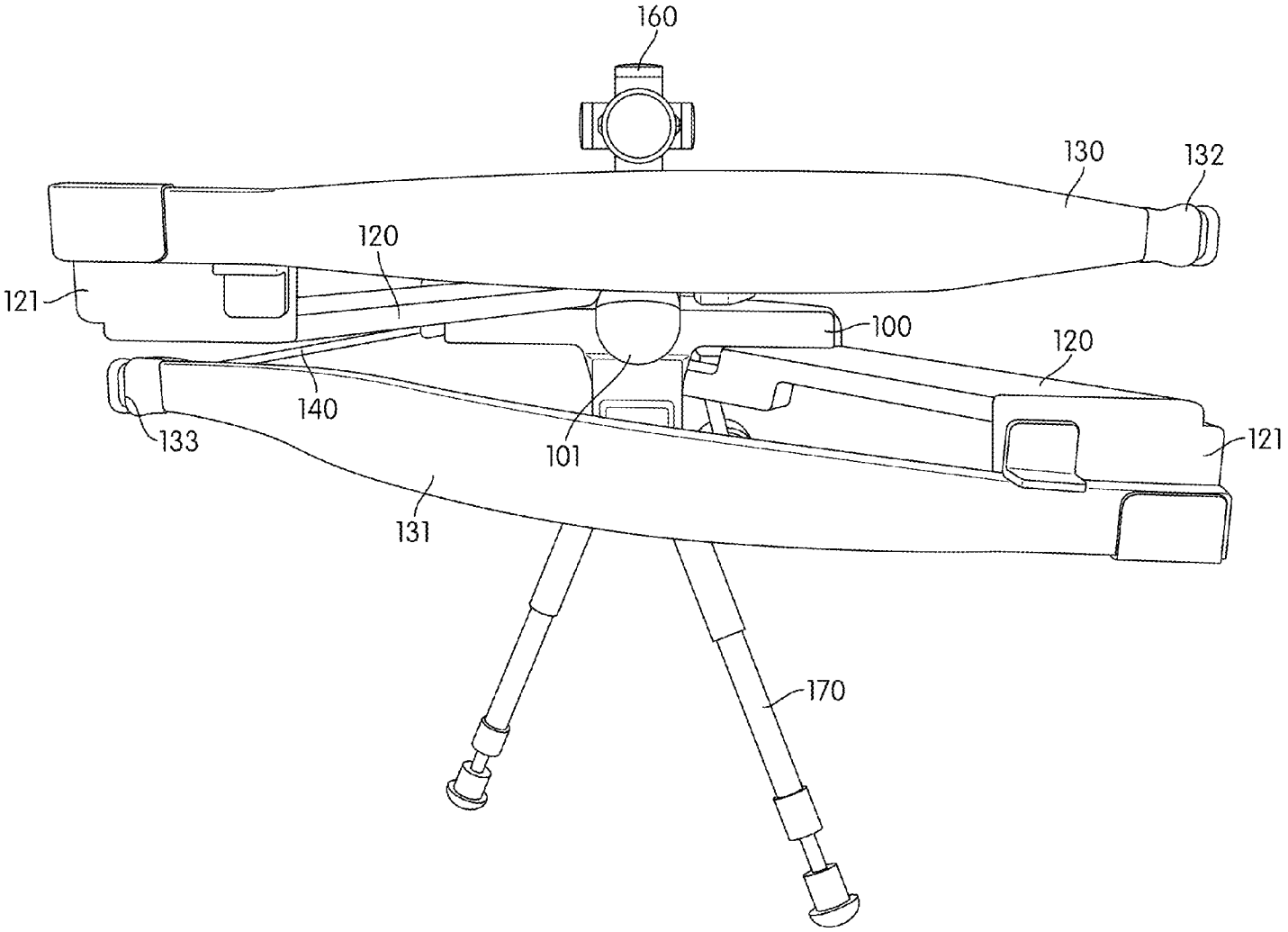
FIG. 3 illustrates a front view of a crossbow in accordance with at least one embodiment of the invention.
Figure 4:
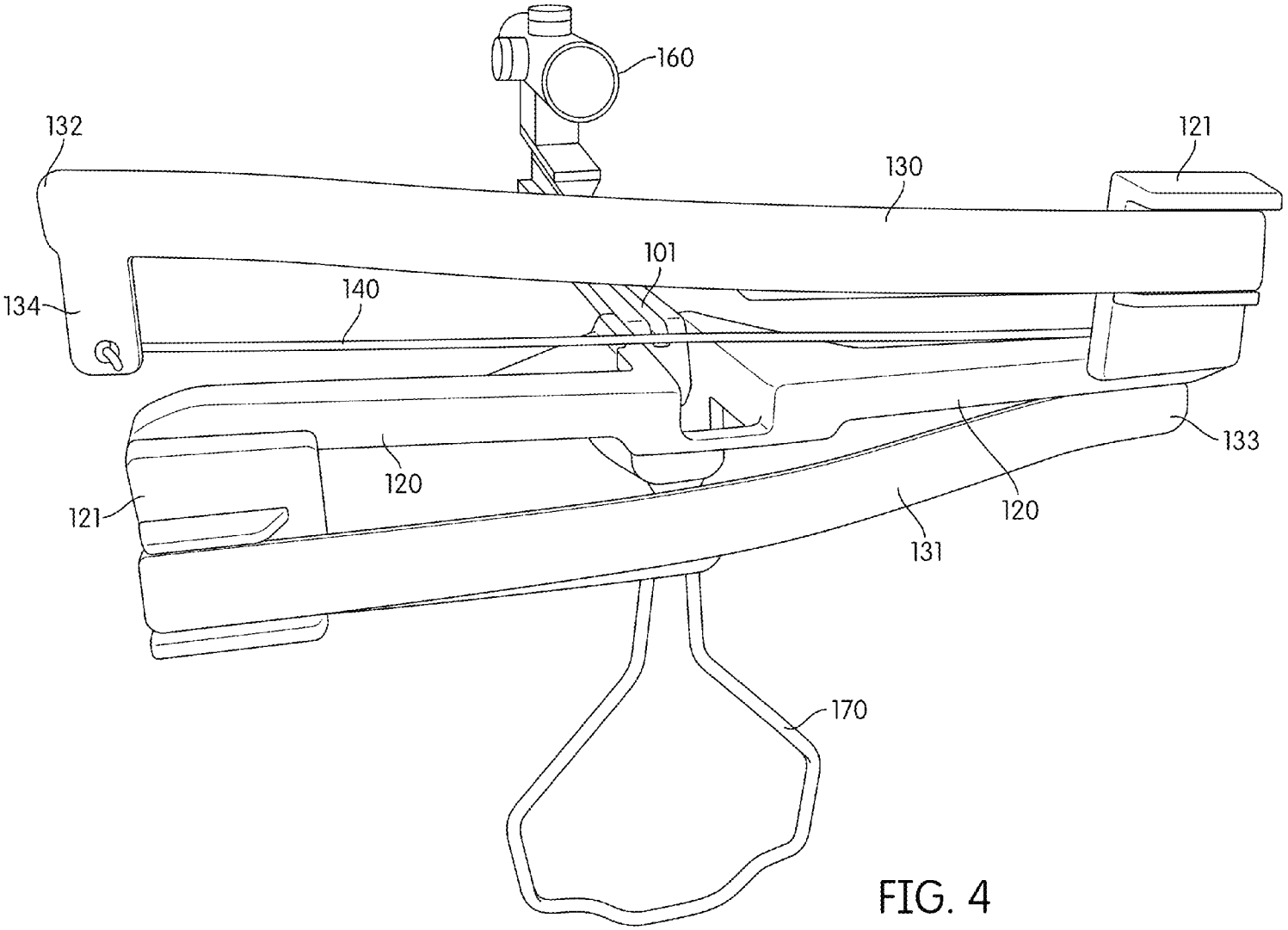
FIG. 4 illustrates a front view of a crossbow in accordance with an alternative embodiment of the invention.

The top limb 130 extends inwardly toward the main frame 100 and extends above the top surface of the main frame 100. The bottom limb 131 extends inwardly toward the main frame 100 and extends below the upper limb 130, as illustrated in FIGS. 3 and 4. In at least one embodiment, the bottom limb 131 extends below a bottom surface of the main frame 100. A space large enough for a bolt 200 to fit through is created between the upper limb 130 and the lower limb 131. The top limb 130 and bottom limb 131 may be made of any suitable material. For example, the top limb 130 and bottom limb 131 may be made out of metal, plastic, fiberglass fiber weave materials, Kevlar, or carbon fiber. The top limb 130 may include an unsupported end 132 opposite the first extension 120. The bottom limb 131 may include an unsupported end 133 opposite the second extension 120.

Figure 5:
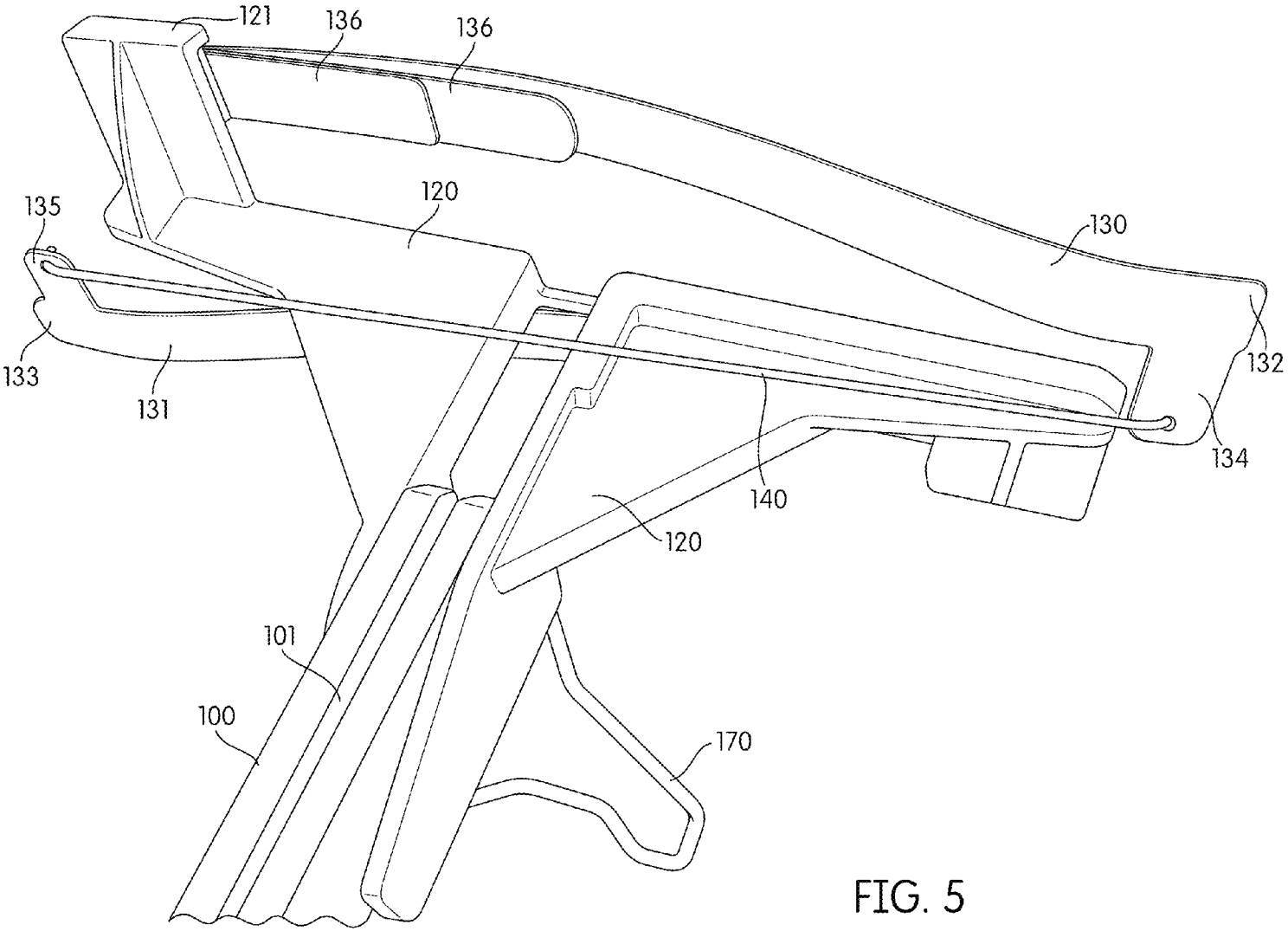
FIG. 5 illustrates a perspective view of a portion of a crossbow in accordance with at least one embodiment of the invention.

The top limb 130 and bottom limb 131 may be any suitable shape. For example, the top limb 130 and bottom limb 131 may be straight or may include a number of bends. The limbs 130 and 131 may be any suitable length, height, and thickness. For example, the thickness of the limbs 130 and 131 may range from 1/16 of an inch to 1 inch. The thickness may be constant throughout or may vary along the limbs 130 and 131. The height of the limbs 130 and 131 may range from a half an inch to 2 inches. The height of the limbs 130 and 131 may be constant or may vary along the limbs 130, 131. The length of the limbs 130 and 131, between the extension 120 and respective unsupported end 132 and 133, may range from 5 inches to 20 inches. In at least one embodiment, the length of the limbs is approximately 15½ inches. As illustrated in FIG. 5, the upper limb 130 and lower limb 131 may include a plurality of reinforcement members 136, which may help facilitate the bending and re-straightening of the limbs 130, 131, and may strengthen the limbs 130, 131 to increase the power of the crossbow.

Referring back to FIG. 1, the crossbow 100 may include a string 140. The string 140 may extend from the unsupported end 132 of the upper limb 130 to the unsupported end 133 of the lower limb 131. The string 140 may be made from any suitable semi-flexible material, such as natural or synthetic fibers. The string 140 may be positioned in a generally horizontal orientation and may extend across the top surface of the main frame 100. The string 140 may be attached to the unsupported ends 132, 133 in any suitable manner. For example, the string 140 may include an eye hook that attaches to the unsupported ends 132, 133. The unsupported ends 132, 133 may include a groove that is configured to engage the string 140. Alternatively, the string 140 may extend through an opening in the unsupported ends 132, 133, as illustrated in FIG. 5.

In at least one embodiment, the limbs 130, 131 may include a projection 134, 135 that extends from the unsupported ends 132, 133, such that the string 140 is configured to attach to the projections 134, 135. For example, the unsupported end 132 of the upper limb 130 may include a projection that extends downwardly toward the bottom limb 131 and the unsupported end 133 of the lower limb 131 includes a projection that extends upwardly toward the upper limb 130. This may allow the string 140 to remain in a horizontal orientation. Alternatively, bends in the limbs 130, 131 may help facilitate the generally horizontal orientation of the string 140. The string 140 may attach to the projections 134, 135 in any suitable manner. For example, the string 140 may be mechanically connected and/or secured to the projections 134, 135. Alternatively, the string 140 may wrap around the projections 134, 135.

Figure 2:
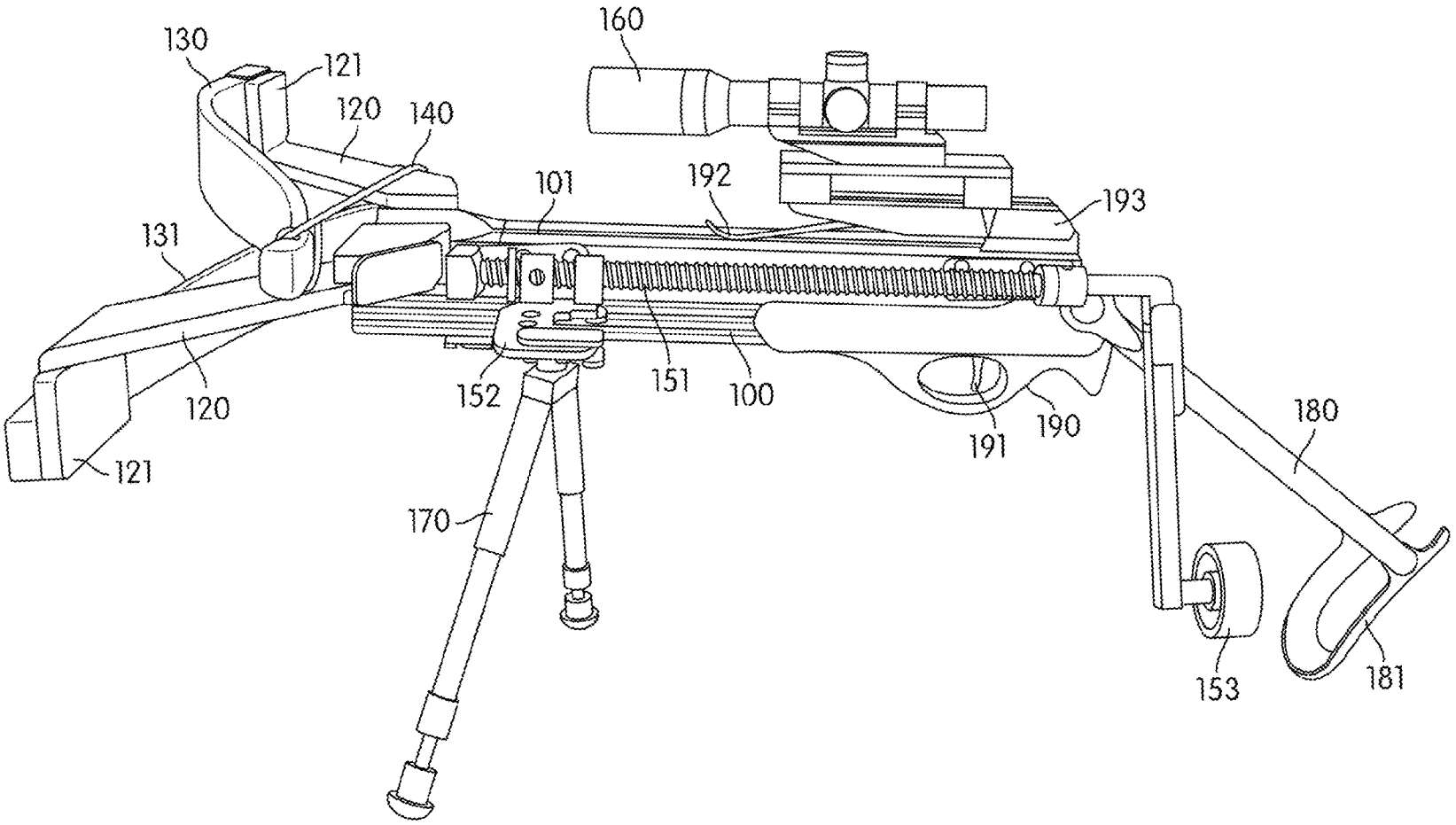
FIG. 2 illustrates a side view of a crossbow in accordance with at least one embodiment of the invention.

As illustrated in FIG. 2, the crossbow 100 may include a trigger assembly 190. The trigger assembly 190 may include a trigger mechanism 191, a retention spring 192, and a mounting surface 193. The trigger assembly 190 may also include a safety lever, which can prevent the trigger mechanism 191 from being pulled. The trigger assembly 190 may be positioned at or near a rear end or rear portion of the main frame 100. The trigger mechanism 191 may be positioned below the bottom surface of the main frame 100. The retention spring 192 may be attached to the mounting surface 193. Both the retention spring 192 and mounting surface 193 may be positioned above the top surface of the main frame 100. The retention spring 192 may extend downwardly from the mounting surface 193 and be configured to engage at least a portion of the string 140.

The crossbow 100 may include a sight 160 for viewing objects at a distance. The sight 160 may be mounted to a top surface of the mounting surface 193 of the trigger assembly 190. The sight 160 may be removably attached to the mounting surface 193. The crossbow 100 may also include a bipod 170. The bipod 170 may be configured to be a stand for at least a portion of the crossbow 100. The bipod 170 may be permanently attached or removably attached to the crossbow 100. The bipod 170 may be attached to the bottom surface of the main frame 100. The bipod 170 may be attached to the main frame 100 in any suitable position. For example, the bipod 170 may be attached near the front end of the main frame 100. The bipod 100 may be a fixed height or may be an adjustable height. The bipod 170 may also be rotatable so as to fold under the crossbow 100. The bipod 170 may include a plurality of legs or may also be configured to be a foot-stirrup as illustrated in FIG. 4.

The crossbow 100 may also include a stock 180, as illustrated in FIG. 2. The stock 180 may be attached to the main frame 100. The stock 180 may be attached to a rear portion of the main frame 100. The stock 180 may be attached to the main frame 100 in any suitable manner. The stock 180 may be removably or permanently attached to the main frame 100. The stock 180 may be collapsible and/or rotatable. In at least one embodiment, the stock 180 may extend and retract. The stock 180 may be configured to rotate such that it folds up underneath the main frame 100. The stock 180 may include an end portion 181 or a butt. The end portion 181 may be configured to be positioned on a person's shoulder. Alternatively, the stock 180 and end 181 may be utilized as a stand for the rear end of the crossbow 100. The end portion 181 may also be rotatable on the stock 180.

The crossbow 100 may also include a worm gear assembly 150 as illustrated in FIG. 1. The worm gear assembly 150 may be configured to engage at least a portion of the string 140 and pull at least a portion of the string 140 toward the trigger assembly 190, such that at least a portion of the string 140 engages with the retention spring 192. The worm gear assembly 150 may include a screw 151, a travel car 152, and a crank 153. The travel car 152 may be configured to rotate at least partially around the screw 151, and include a coupling 155 that engages with the screw 151. The travel car 152 may include a projection 154 that is configured to engage with at least a portion of the string 140. The screw 151 may extend the entire length of the main frame 100 or a portion of the length of the main frame 100. In at least one embodiment, the screw 151 is positioned adjacent a surface of the main frame, such as a side surface. The crank 153 may be positioned at or near an end of the screw 151. Alternatively, the crank 153 may be positioned near the end of the stock 180.

To cock the string 140, the travel car 152 may be rotated towards the main frame 100. The projection 154 on the travel car 152 may engage with the string 140. The crank 153 may be rotated, which causes the screw 151 to rotate and the travel car 152 to travel along the length of the screw 151. In at least one embodiment, the crank 153 may be automated rather than manually rotated. The travel car 152 draws the portion of the string 140 to the retention spring 192. The retention spring 192 may lock the portion of the string 140 until the trigger mechanism 191 is pulled (i.e. fired). When the string is cocked, the upper limb 130 and lower limb 130 may bend, creating a spring-like effect. When the upper limb 130 and lower limb 131 are bent, the string 140 is in tension, which creates a kinetic energy that can be transferred to a bolt 200.

When the string 140 is cocked, the unsupported end 132 of the upper limb 130 and the unsupported end 133 of the lower limb 131 are drawn closer together. In at least one embodiment, the angle between the unsupported end 132 of the upper limb 130 and the unsupported end 133 of the lower limb 131 when the string 140 is cocked is approximately 30 degrees. The angle between the upper and lower limbs 130, 131, respectively, may be any suitable angle and may range from 10 degrees to 60 degrees. When the string 140 is cocked, the upper limb 130 and lower limb 131 may deflect from their resting position. The deflection may be any suitable amount of deflection to create the requisite power to shoot a bolt 200. For example, the deflection may range from 10 to fifteen inches. In at least one embodiment, the deflection is approximately 12 inches. Once the trigger mechanism 191 is fired, the retention spring 192 releases the portion of the string 140, such that a bolt or an arrow 200 can be fired from the crossbow 100. Alternatively, a standard cocking mechanism, such as a string or rope cocking mechanism, may be utilized with the crossbow 100.

Figure 6:
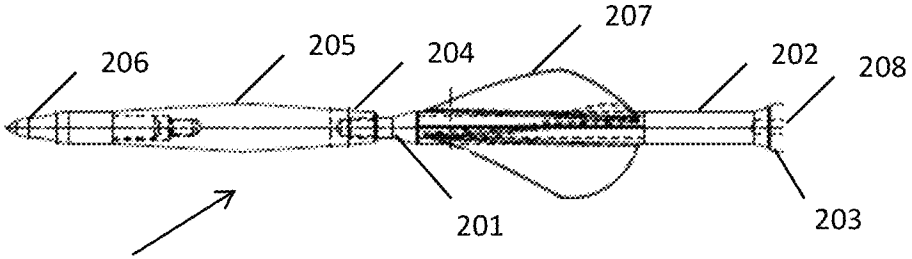
FIG. 6 illustrates a bolt in accordance with at least one embodiment of the invention.

As illustrated in FIG. 6, a bolt 200 is described. The bolt 200 may be configured to be discharged from the crossbow 100. In at least one embodiment, the bolt 200 includes a body 201, a coupling 205, and a tip 206. The bolt 200 may be made of any suitable material or combination of materials. For example, the body 201 may be formed from a plastic or a metal such as aluminum. The coupling 205 may be formed from a plastic or a metal such as brass. The tips 206 may be any suitable material to penetrate the intended target.

Figure 7:
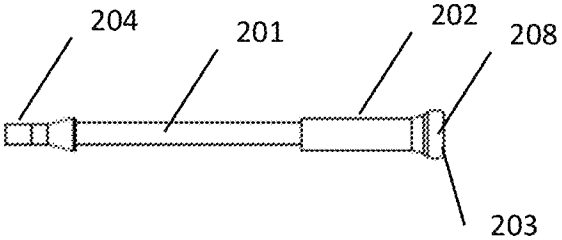
FIG. 7 illustrates a portion of the bolt in accordance with at least one embodiment of the invention.

As illustrated in FIG. 7, the body 201 may include an end portion 202 that has a nock 203. The nock 203 may be configured to engage with at least a portion of the string 140. The nock 203 may also include a threaded opening 208 configured to receive a portion of another bolt 200, which may facilitate removal of the bolt 200 from a target. The body 201 may include a front portion 204 that attaches to a coupling 205. The coupling 205 may be of unitary construction with the body 201 or may be removable from the body 201. The tip 206 may be connected to a front end of the coupling 205. The tip 206 may be removable or permanently attached to the coupling 205. In at least one embodiment, the coupling 205 is configured to attach to a plurality of different tips 206. The tips 206 can be different shapes or sizes and/or include projections extending from the tips.

Figure 8:
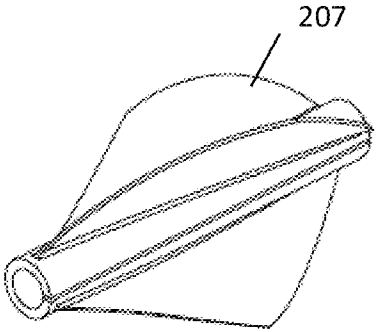
FIG. 8 illustrates a fletching for a bolt in accordance with at least one embodiment of the invention.

In at least one embodiment, as illustrated in FIG. 8, a fletching or feathers 207 may be attached to the bolt 200. The fletching 207 may be made of any suitable material such as rubber or plastic. In at least one embodiment, the fletching 207 may snap-on to the body 201. The fletching 207 may be positioned anywhere on the body 201 of the bolt 200. In at least one embodiment, the fletching 207 is positioned near the middle of the body 201 between the end portion 202 and the front portion 204. The fletching 207 may include a plurality of projections or blades that extend outwardly to aid the travel of bolt 200 through the air. In at least one embodiment, the projections or blades are configured to be positioned within the groove 101 of the main frame 100.

The bolt 200 may be any suitable shape or size. For example, the bolt 200 may be anywhere from 2 to 20 inches long. In at least one embodiment, the bolt 200 is approximately 7 inches long. In at least one embodiment, the coupling 205 includes a bulbous portion. The bolt 200 is configured to be positioned on or within the groove 101 in the main frame 100. In at least one embodiment, only the nock 203 and one portion of the coupling 205 contact the main frame 100. This may provide for minimal friction when the bolt 200 travels along the main frame 100.

The bolt 200 is configured to engage with the string 140 and be discharged from the crossbow 100. Once the crossbow 100 is fired, the bolt 200 is configured to travel along the top surface of the main frame 100 and may travel on or within the groove 101. The bolt 200 may travel through the opening created between the top limb 130 and the bottom limb 131 towards a target.

Variations and modifications of the foregoing are within the scope of the present invention. For example, one of skill in the art will understand that the described components may be used in various configurations. The different embodiments may be used separately or may be combined together in a single system. The present invention is therefore not to be limited to a single system depicted in the Figures, as the system is simply illustrative of the features, teachings and principles of the invention. It should further be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. An apparatus comprising:
a main frame having a top surface;
a groove defined in the top surface;
a first extension extending outwardly from a first side of the top surface on a front end of the main frame;
an upper limb mounted to the first extension, the upper limb extending inwardly and above the main frame, the upper limb defining an unsupported end;
a second extension extending outwardly from a second side of the top surface of the front end of the main frame;
a lower limb mounted to the second extension, the lower limb extending inwardly and below the upper limb, the lower limb defining an unsupported end;
a trigger assembly mounted to a rear end of the main frame; and
a string attached to the unsupported end of upper limb and the unsupported end of the lower limb, wherein the string extends across the top surface of the main frame,
wherein at least a portion of the string is configured to extend along at least a portion of the top surface of the main frame and engage with the trigger assembly.

2. The apparatus of claim 1, further comprising:
a collapsible stock attached to a rear end of the main frame.

3. The apparatus of claim 1, further comprising:
a removable bipod attached to a front end of the main frame.

4. The apparatus of claim 1, further comprising:
a worm gear assembly having a travel car that is configured to rotate, engage at least a portion of the string, and travel along the top surface of the main frame, and a crank that when rotated, causes the travel car to move along the top surface of the main frame.

5. The apparatus of claim 1, further comprising:
a sight mounted on a top surface of the trigger assembly.

6. The apparatus of claim 1, wherein the limbs are fiberglass.

7. The apparatus of claim 1, wherein the limbs are metal.

8. The apparatus of claim 1, wherein the trigger assembly is configured to lock the string in a tensioned position and release the string upon firing the trigger assembly.

9. The apparatus of claim 8, wherein at least a portion of a bolt is configured to rest on the groove of the main frame, wherein an end of the bolt is configured to engage with the string, and the bolt is configured to be fired from the apparatus when the trigger assembly is fired.

10. The apparatus of claim 9, wherein the bolt is configured to travel between the upper and lower limbs upon firing of the trigger assembly.

11. An apparatus comprising:
a main frame having a top surface;
a groove defined in the top surface;
a first extension extending outwardly from a first side of the top surface on a front end of the main frame;
an upper limb mounted to the first extension, the upper limb extending inwardly and above the main frame, the upper limb defining an unsupported end;
a second extension extending outwardly from a second side of the top surface on a front end of the main frame;
a lower limb mounted to the second extension, the lower limb extending inwardly and below the upper limb, the lower limb defining an unsupported end;
a trigger assembly mounted to a rear end of the main frame;
a string attached to the unsupported end of upper limb and the unsupported end of the lower limb, wherein the string extends across the top surface of the main frame; and
a worm gear assembly having a travel car that is configured to rotate, engage at least a portion of the string, and travel along the top surface of the main frame, and a crank that when rotated, causes the travel car to move along the top surface of the main frame; and
wherein at least a portion of the string is configured to be pulled along at least a portion of the top surface of the main frame by the travel car and engage with the trigger assembly.

12. The apparatus of claim 11, further comprising:
a collapsible stock attached to a rear end of the main frame.

13. The apparatus of claim 11, further comprising:
a removable bipod attached to a front end of the main frame.

14. The apparatus of claim 11, wherein the trigger assembly is configured to lock the string in a tensioned position and release the string upon firing the trigger assembly.

15. A system comprising:
a crossbow comprising:
a main frame having a top surface;
a groove defined in the stop surface;
a first extension extending outwardly from a first side of the top surface on a front end of the main frame;
an upper limb mounted to the first extension, the upper limb extending inwardly and above the main frame, the upper limb defining an unsupported end;
a second extension extending outwardly from a second side of the top surface on a front end of the main frame;
a lower limb mounted to the second extension, the lower limb extending inwardly and below the upper limb, the lower limb defining an unsupported end;
a trigger assembly mounted to a rear end of the main frame; and
a string attached to the unsupported end of upper limb and the unsupported end of the lower limb, wherein the string extends across the top surface of the main frame,
wherein at least a portion of the string is configured to extend along at least a portion of the top surface of the main frame and engage with the trigger assembly; and
at least one bolt, wherein at least a portion of the at least one bolt is configured to rest on the groove of the main frame, wherein an end of the at least one bolt is configured to engage with the string, and the at least one bolt is configured to be fired from the crossbow when the trigger assembly is fired, and
wherein the bolt is configured to travel between the upper and lower limbs upon firing of the trigger assembly.

16. The system of claim 15, wherein the bolt includes a removable coupling.

17. The system of claim 16, wherein only the end of the bolt and a portion of the removable coupling are configured to rest on the groove of the main frame.

18. The system of claim 15, wherein the bolt includes a snap-on fletching.

19. The system of claim 18, wherein the snap-on fletching covers only a portion of the bolt.

20. The system of claim 15, wherein the bolt includes a removable tip.

* * * * *